United States Patent [19]

Greten

[11] 4,023,776

[45] May 17, 1977

[54] PROCESS AND APPARATUS FOR THE PRODUCTION OF CHIPBOARDS, OR LIKE PANELS FROM A MIXED MATERIAL

[75] Inventor: Berndt Greten, Springe, Germany

[73] Assignee: Bison-werke Bahre & Greten GmbH & Co. KG, Germany

[22] Filed: July 15, 1974

[21] Appl. No.: 488,658

[30] Foreign Application Priority Data

July 13, 1973 Germany ..... 2335814

[52] U.S. Cl. ..... 259/2

[51] Int. Cl.[2] ..... B01F 13/00

[58] Field of Search ..... 259/2, 13, 20, 29, 3 S, 259/75, 91, 5, 37, 40, 41, 42, 45, 46, 72, 1 R; 222/145, 415

[56] References Cited

UNITED STATES PATENTS

| | | | |
|---|---|---|---|
| 3,150,215 | 9/1964 | Houghton | 259/20 X |
| 3,271,492 | 9/1966 | Elmendorf | 264/122 |
| 3,336,006 | 8/1967 | Berg | 259/37 |
| 3,558,105 | 1/1971 | Moritz | 259/2 |
| 3,565,650 | 2/1971 | Cordon | 264/122 X |
| 3,570,817 | 3/1971 | Claussen | 259/46 |
| 3,670,063 | 6/1972 | Berthold | 264/122 X |
| 3,814,386 | 6/1974 | Guglietti | 259/2 |

*Primary Examiner*—Robert W. Jenkins
*Attorney, Agent, or Firm*—Craig & Antonelli

[57] ABSTRACT

Process and apparatus for the production of chipboards, fiberboards, or like panels from a mixed material, the components of which have specific gravities that differ relatively greatly from one another. In one preferred embodiment, the components are fed separately from one another to the bottom belt of a mixing bin to form a plurality of thin layers. The mixing bin is arranged upstream of a fine-metering device, which in turn, meters the mixed material for feeding into a press. Another preferred embodiment feeds the mixture components to the bottom belt mixing bin together, while depositing the mixture material in obliquely oriented layers in superimposed strata so that the angle of each layer is smaller with respect to the horizontal than the natural angle of repose of the individual mixer components.

26 Claims, 2 Drawing Figures

PROCESS AND APPARATUS FOR THE PRODUCTION OF CHIPBOARDS, OR LIKE PANELS FROM A MIXED MATERIAL

BACKGROUND OF THE INVENTION

This invention relates to a process and apparatus for the production of chipboards, fiberboards, or like panels from a mixed material, the components of which have specific gravities that differ relatively greatly from one another.

The mixed material required for the production of chipboards, fiberboards, or the like, for example a mixture of chips for the cover layer and/or chips for the middle layer, combined with binders, is generally fed to a so-called bottom floor belt mixing bin, i.e. a bin, the bottom of which consists of an endless belt extending in the horizontal and drivable with a controllable speed, this bin being provided at its discharge end with an adjustably disposed scraper belt covering the entire cross section of the bin. The mixed material is then discharged from the bottom belt mixing bin in metered quantities and fed to a charging means which deposits a chip or fiber cake onto a support, such as an endless belt, which is movable in most cases. Between the bottom belt mixing bin and the feeding means, the mixed material is subjected to a weight and/or volume control to produce from the shaped cake a panel having a maximally uniform bulk density and specific gravity (German Pat. Nos. 1,088,697; 1,156,219; and DOS [German Unexamined Laid-Open Application] 1,528,234; Franz Kollmann "Holzspan-Werkstoffe" [Wood Chip Materials], Berlin-Heidelberg-New York, 1966, p. 229).

Although the general opinion heretofore has been that the bulk density and/or specific gravity distribution within a thus-manufactured panel is sufficiently uniform with constant monitoring and continuous servicing of the entire plant, particularly the control elements, it was found unfortunately that deviations of up to 7% occur (J. Deppe and K. Ernst "Technologie der Spanplatten" *Chipboard Technology*, Central Wood Bulletin publishers, Stuttgart, 1964, pp. 154 and 155).

Therefore, the invention is based on the problem of reducing deviations in the bulk density and specific gravity distribution in chipboards, fiberboards, or the like to a practically negligible minimum.

The invention starts with the recognition that the mixed material to be metered is segregated not only during its transport to the bottom belt mixing bin but also during the intermediate storage in such a bin, especially if the specific gravities of the individual components of the material to be mixed deviate relatively greatly from one another. This is the case, inter alia (e.g. components of pine and beech) particularly in case of mixed materials made up of wood chips, cement, and water (U.S. Pat. No. 3,271,492) and/or mixed materials made from bagasse, hemp, flex, or the like with water and cement. If material to be mixed, which in most cases has already separated during transport, is introduced into a bottom belt mixing bin, the components of this material moistened with water as well as those saturated with water sink down primarily to the lower zone of the bottom belt mixing bin during the intermediate storage, which is undesirable.

In order to solve the above-described problem, several methods are contemplated by the present invention. Thus, it is contemplated by the present invention, especially if a strong segregation is to be expected during transportation, to feed the mixture components, for example glue-covered chips on the one hand and cement on the other, of fibers on the one hand and cement or the like on the other, separately from each other before the metered feeding to the charging station, and to deposit these substances in the bottom belt mixing bin in superimposed, relatively thin layers, the mixing step being conducted during such feeding and also after such feeding has been accomplished. The question when the required water is fed to the mixed material is of secondary significance in this connection; therefore, it is possible to combine the material with water, for example, during an intermediate storage as well as during the feeding to a charging means.

However, it is further contemplated according to another embodiment of the invention to feed the mixture components to a bottom belt mixing bin together, and then to deposit this mixture material in obliquely oriented layers in the bottom belt mixing bin, in superimposed strata, so that the angle of each layer is smaller with respect to the horizontal than the natural charging angle (angle of repose) of the individual mixture components. Here again, the components are being mixed together during the charging step and after this charging step is finished.

When speaking of relatively thin layers of the individual components and/or of relatively thin layers of the mixture material in describing the present invention, this means thickness of the individual layers of a few centimeters. If, in such a case, the thickness of the strewed chip or fiber cake is 60 mm., and this cake is then compacted, for example, to 20 mm. in a press, then differences in the bulk density and specific gravity distribution are, with a thus-produced panel, approximately 1%, so that a quite considerable advance in the art has been attained.

These two above-noted processes and devices for executing these processes will be explained hereinbelow with reference to the examples schematically illustrated in the drawings.

DETAILED DESCRIPTION OF THE DRAWINGS

Figure 1:
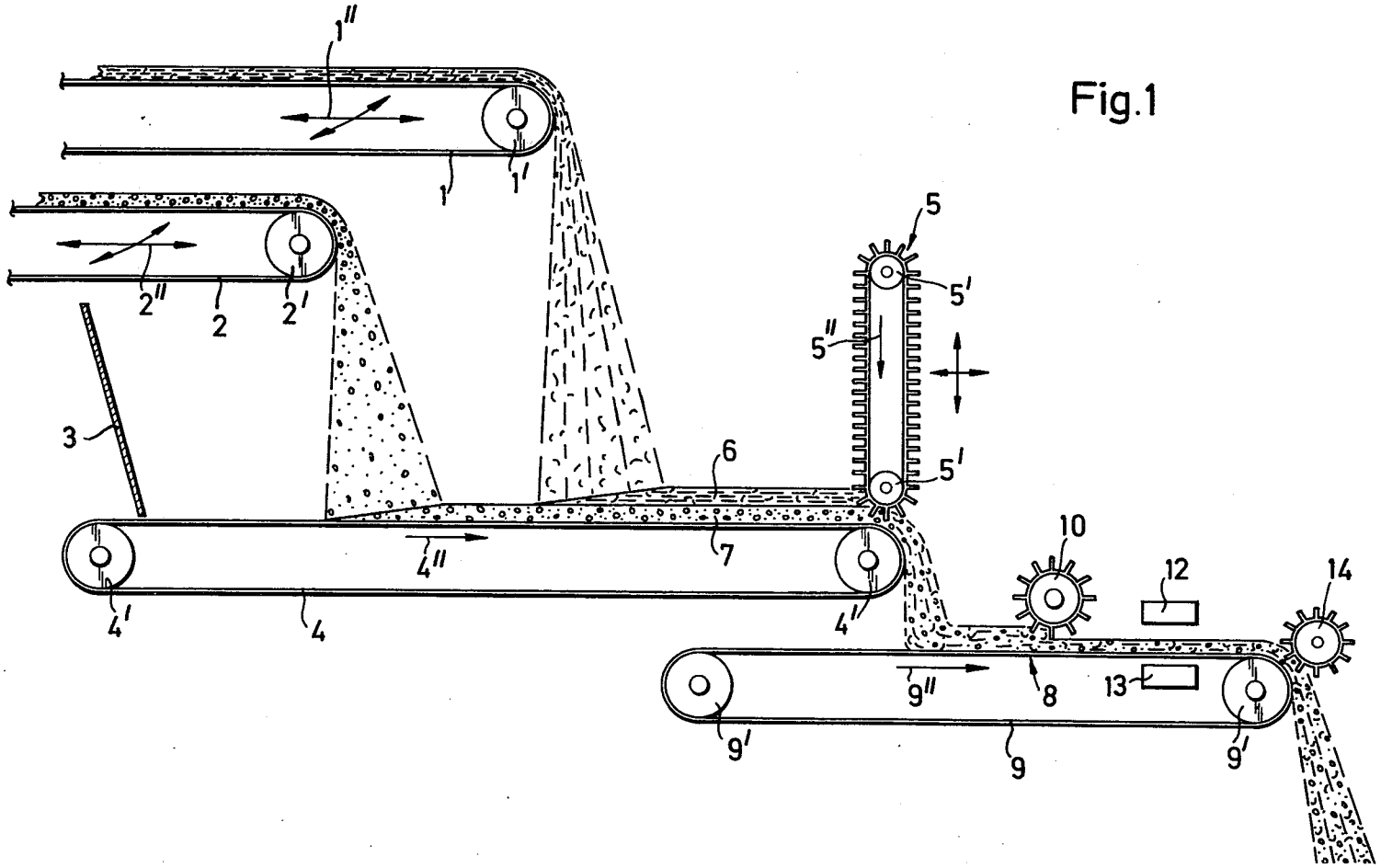
FIG. 1 shows a lateral schematic view of an apparatus of this invention, wherein the components of a mixed material to be processed into panels are fed separately from each other to a bottom belt mixing bin and then to a fine-metering device.

One component of a mixed material, for example a layer 6 of chips, is fed to a bottom belt mixing bin 3 by way of an endless belt 1 extending in the horizontal direction and drivable with controllable speed. This endless belt 1 is guided over guide rolls, of which only one guide roll 1' is shown. The other component of a mixed material, for example cement 7, is likewise fed to this bottom belt mixing bin via a second endless belt 2, likewise extending in the horizontal and drivable at controllable speed. This belt is guided over guide rolls, of which only one guide roll 2' is illustrated. The guide roll 2' of the lower endless belt 2 is mounted and disposed so that it is constantly positioned underneath the lower belt fact of the upper endless belt 1, i.e. it is offset rearwardly with respect to the guide roll 1', as shown. If the spacings between the axes of rotation of the guide rolls pertaining to the upper endless belt 1 and the spacing of the guide rolls of the lower endless belt 2 are identical, which is not absolutely necessary, then the components of some kind of mixture material, to be charged via these endless belts, can be deposited relatively simply onto the endless belts and charged into the bottom belt mixing bin 3.

The floor of the bottom belt mixing bin 3 consists of an endless belt 4 which is guided by fixedly arranged guide rolls 4' and is drivable with an adjustable and/or variable speed. The discharge end of the bottom belt mixing bin 3 is formed by a scraper belt 5 guided about guide rolls 5' and being driven, for example in the same manner as the endless belt 4.

The two endless belts 1 and 2 are moved at least in the directions indicated by the double arrows 1'' and 2'', respectively, together to and fro above the bottom belt mixing bin 3, so that the charging points of the mixture material components determined by the guide rolls 1' and 2' are moved back and forth above the bin 3. It is assumed that the charging of the bottom belt mixing bin 3 was started when the two endless belts 1 and 2 were in their extreme right-hand positions. Thus, the two layers 7 and 6 were deposited on the upper face of the endless belt 4, which was not as yet set into rotation. Once the two endless belts have reached their outer left-hand position, two superimposed layers of the two main components of the mixture material are present in the bottom belt mixing bin. At this point in time, the two endless belts, 1, 2 are moved from the left toward the right and then again to the left, until the bin contains several superimposed layers of different components of mixture material.

The mixture material, deposited in layers, can be discharged as soon as a certain number of layers is present in the bottom belt mixing bin, for example four superimposed layers. The endless belt 4 is then set into rotation in the direction of the arow 4'', and the scraper belt 5 is set into motion in the direction of the arrow 5''. The scraper belt 5 is fashioned to be adjustable with respect to its height as well as in the lateral directions, as expressed by crossed arrows indicated to the right of the scraper belt.

The material discharged from the bottom belt mixing bin 3 then passes on to a fine-metering means 8, the bottom of which consists of an endless belt 9 guided by guide rolls 9' and driven in a suitable manner. The upper belt face then moves in the direction of arrow 9''. The fine-metering means 8 is associated with a stripping rake 10. This rake 10 is of known construction in and by itself, and determines the thickness of the layer of mixed material on the endless belt 9. Behind the stripping rake 10, a radiation receiver 12 is arranged above the top face of the belt, and a radiation transmitter 13 is disposed underneath the top belt face. These devices 12 and 13 serve, in a conventional manner, for the control of the weight per unit area. The layer of mixed material is then fed to a feeding means, not shown, via a throw-off roll 14 in a likewise known procedure; the feeding means is arranged underneath the discharge zone of the endless belt 9.

It is furthermore worth mentioning that the endless belts 1 and 2, which convey mixture components to the bottom belt mixing bin 3, can also be fashioned as so-called swivel belts according to other preferred embodiments of the invention. For example, belts 1 and 2 may be mounted and disposed so that they are pivotable about a vertical axis, either together or independently of each other. In place of the endlss belts 1, 2, it is also contemplated by the present invention to provide other conveying means, such as, for example, worm conveyors in an analogous arrangement.

Figure 2:
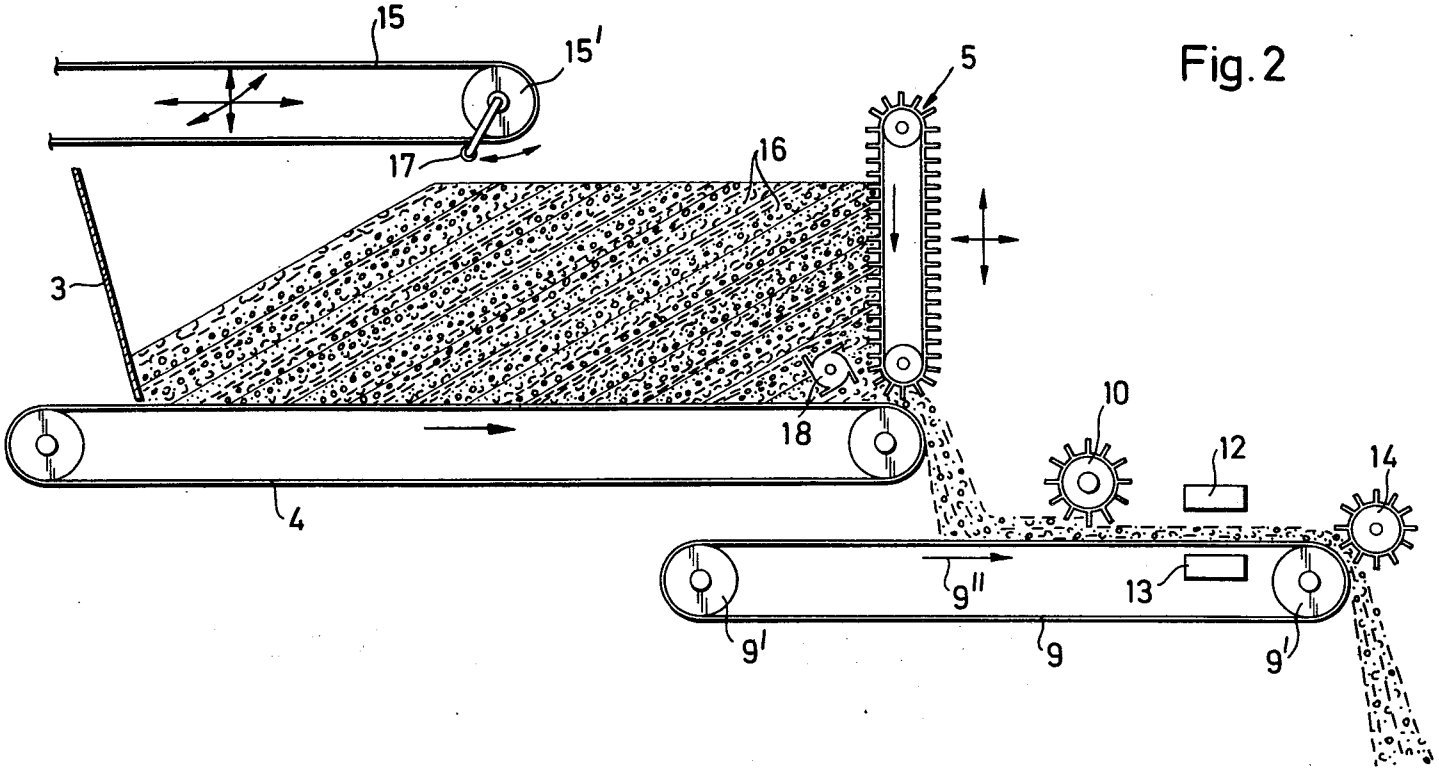
FIG. 2 shows a lateral schematic view of another apparatus constructed in accordance with this invention, wherein the mixed material, containing all components, is fed to a bottom belt mixing bin and then to a fine-metering device.

In case of the embodiment shown in FIG. 2, it is assumed that the mixed material has already been prepared from various components, so that it can be charged into the bottom belt mixing bin 3 by way of a single endless belt 15. Since in this case the individual layers 16 are to be deposited obliquely in the bottom belt mixing bin 3, the endless belt 15, guided over guide rolls 15', here again is moved to and fro in the horizontal direction, as explained in connection with the embodiment of FIG. 1. Also, care is taken that the rotating speed of the endless belt 15 as well as the moving speed of the feeding consisting of the guide rolls 15' and the endless belt 15 are continuously variable. Thus, for example, if it is intended to deposit an inclined layer 16 and the mixture material layer on the endless belt 15 is started to be fed in the zone of the scraper belt 5, then provisions are made that either the endless belt 15, if the roller 15' is in this position, rotates faster than at other places located to the left of this position; or the feeding means is allowed to stand still at this point for a larger period of time than at other points. Moreover, it is advantageous to pivot the entire feeding device also about a horizontal axis, so that the guide roll 15' during the laying of the individual layers is always moved in the proximity of the previously laid layer, because then the path to be traversed by the introduced mixture material to reach a layer is relatively short. The filling height in the bottom belt mixing bin 3, i.e. the number of superimposed layers, as well as the motion of the feeding means 15, is regulated by control elements, such as, for example, a feeler 17 or the like.

It is moreover advantageous to arrange a separating means 18, consisting of a roll with spikes, brushes, or the like in front of the discharge point of the bottom belt mixing bin 3, within this bin 3 in the zone between the endless belt 4 and the scraper belt 5. This separating means 18 also contributes toward making the mixture material more uniform.

While I have shown and described several embodiments in accordance with the present invention, it is understood that the same is not limited thereto but is susceptible or numerous changes and modifications as known to those skilled in the art and I therefore do not wish to be limited to the details shown and described herein but intend to cover all such changes and modifications as are encompassed by the scope of the appended claims.

What is claimed is:

1. In a charging device for charging a feeding device for feeding a mixed material composed of components having specific gravities differing relatively greatly from one another to a cake-forming machine to form chipboards, fiberboards or the like panels having a substantially uniform specific gravity distribution, said charging device including a chamber for receiving components of said mixed material, said chamber having a discharge opening in a lower portion thereof, discharge means for discharging said mixed material from said chamber through said discharge opening to said feeding device, and supply means for supplying said components to said chamber, the improvement for improving the specific gravity distribution in the panels to be manufactured comprising means mounting and controlling said supply means so that said supply means deposits said components in said chamber in superposed relatively thin layers, said discharge means engaging the leading face of the mass of material formed by the superimposed layers, said discharge means stripping off the material of each layer to facilitate mixing of said material as said material passes out of said discharge opening.

2. The apparatus according to claim 1, wherein said chamber is formed by a bin having a bottom composed of a horizontally extending driveable endless belt, said discharge means being provided at the discharge end of said bin and forming with said endless belt said discharge opening.

3. Apparatus according to claim 2, wherein said discharge means is a scraper belt.

4. Apparatus according to claim 2, wherein said supply means is mounted for horizontal reciprocation in the travel direction of said endless belt.

5. Apparatus according to claim 4, wherein said supply means is mounted for horizontal reciprocation between a first position in which component supplied from said supply means is deposited adjacent the discharge end of said bin and a second position wherein component supplied from said supply means is deposited adjacent the upstream end of said bin.

6. Apparatus according to claim 5, wherein said apparatus includes at least two supply means.

7. Apparatus according to claim 6, wherein said means mounting and controlling said supply means moves said supply means such that the components are deposited in superimposed relatively thin substantially horizontal layers.

8. Apparatus according to claim 5, and comprising only one supply means for supplying said mixed material to said bin, said means mounting and controlling said supply means moving said supply means so that said mixed material is deposited in superimposed relatively thin layers oriented obliquely with respect to the horizontal.

9. Apparatus according to claim 8, characterized in that a separating device consisting of a roll with spikes, brushes, or the like is disposed in front of the discharge point of the bottom belt mixing bin.

10. Apparatus according to claim 8, wherein said supply means is pivotable about a vertical axis.

11. Apparatus according to claim 8, wherein said supply means is pivotable about a horizontal axis.

12. Apparatus according to claim 2 further comprising fine-metering means for transferring mixed material passing out of said bin to said feeding device.

13. Apparatus according to claim 12, wherein said fine-metering means is composed of an endless belt and a stripping rake spaced therefrom for raking mixed material conveyed by said endless belt.

14. Apparatus according to claim 2 characterized in that a fine-metering device is arranged after the bottom belt mixing bin and, underneath the throw-off zone of the fine-metering device, a cake forming machine is arranged which operates according to the air separation and throw-strewing principle.

15. Apparatus according to claim 14, characterized in that the fine-metering device operates continuously.

16. In a supply apparatus for continuously supplying a mixed material composed of components having specific gravities differing relatively greatly from one another to a receiving station in substantially uniform admixture, said supply apparatus including a bin defined on the bottom with a horizontally disposed driveable endless belt and on the distance end thereof with discharge means defining with said endless belt a discharge opening in said bin, and supply means for supplying components of said mixed material to said bin, the improvement comprising means mounting and controlling said supply means so that said components are deposited in said bin in superimposed relatively thin layers, said discharge means engaging the leading face of the mass of material formed by the superimposed layers, said discharge means stripping off the material of each layer to facilitate mixing of said material as said material passes out of said discharge opening.

17. Apparatus according to claim 16, wherein said supply means is mounted for horizontal reciprocation in the travel direction of said endless belt.

18. Apparatus according to claim 17, wherein said supply means is further mounted so as to be pivotable about a vertical axis.

19. In a charging process for charging a feeding device for feeding a mixed material composed of components having specific gravities differing relatively greatly from one another to a cake-forming machine to form chipboards, fiberboards or the like panels having a substantially uniform specific density distribution, said charging process including feeding the components of said mixed material to a chamber having an opening in a lower portion therein and discharging said mixed material from said opening to said feeding device, the improvement for improving the specific gravity distribution in the panels to be manufactured comprising feeding said components to said chamber by depositing said components in said chamber in superimposed relatively thin layers, and stripping off the material of each layer with discharge means engaging the leading face of the mass of material formed by the superimposed layers to facilitate mixing of said material as said material passes out of said opening.

20. The process of claim 19, wherein said chamber is composed of a bin defined on the bottom with a horizontally disposed driveable endless belt and on the discharge end thereof with discharge means defining with said endless belt a discharge opening in said bin, said mixed material being discharged from said bin by said endless belt and said discharge means.

21. The process of claim 20, wherein said components are supplied by supply means horizontally reciprocating over said bin to deposit said components on said endless belt in said relatively thin layers.

22. The process of claim 21, wherein said supply means reciprocates in the travel direction of said endless belt.

23. The process of claim 21, wherein said supply means pivots about a vertical axis.

24. The process of claim 20, wherein said mixed material is supplied to said bin by a single supply means moveable so as to deposit said mixed material on said endless belt in said relatively thin layers.

25. The process of claim 24, wherein said supply means moves to deposit said relatively thin layers obliquely with respect to the horizontal.

26. The process of claim 20, wherein a plurality of components are supplied to said bin by a plurality of supply means, each supply means moving to deposit the component supplied therefrom in a substantially horizontal relatively thin layer.

* * * * *